United States Patent [19]

Bauer et al.

[11] 4,206,351

[45] Jun. 3, 1980

[54] ELECTRORADIOGRAPHIC APPARATUS

[75] Inventors: Walter Bauer, Munich; Heinz Kröbel, Taufkirchen, both of Fed. Rep. of Germany

[73] Assignee: Agfa-Gevaert Aktiengesellschaft, Leverkusen, Fed. Rep. of Germany

[21] Appl. No.: 939,131

[22] Filed: Sep. 1, 1978

[30] Foreign Application Priority Data

Sep. 2, 1977 [DE] Fed. Rep. of Germany ..... 2739652

[51] Int. Cl.[2] ..... G03G 15/00

[52] U.S. Cl. ..... 250/315.2

[58] Field of Search ..... 250/315 A, 315 R

[56] References Cited

U.S. PATENT DOCUMENTS

| | | | |
|---|---|---|---|
| 3,873,832 | 3/1975 | Eseke | 250/315 A |
| 4,061,915 | 12/1977 | Pfeifer | 250/315 A |
| 4,074,133 | 2/1978 | Muller | 250/315 A |

*Primary Examiner*—Craig E. Church

*Attorney, Agent, or Firm*—Peter K. Kontler

[57] ABSTRACT

Dielectric receptor sheets which are transported seriatim from a tray into the gas-filled interelectrode gap of an ionography imaging chamber are arrested ahead of the chamber, and a corona generating device is moved along each arrested sheet to apply a uniform electrostatic charge to or to neutralize the electrostatic charge of the arrested sheet. Each arrested sheet whose charge is influenced by the corona generating device is attracted by suction to the concave side of an arcuate guide. The corona generating device is mounted on a carrier which is pivotable about an axis including the center of curvature of the concave side of the guide. The carrier further supports a pivotable retainer which moves the central portions of the leaders of successive sheets against the concave side of the guide if the leaders exhibit the tendency to bend or bulge away from the concave side. The marginal portions of sheets which are advanced along the guide extend into arcuate channels which flank the concave side. The treatment by the corona generating device can serve to destroy non-uniform positive or negative charges or to apply uniform background potential.

15 Claims, 1 Drawing Figure

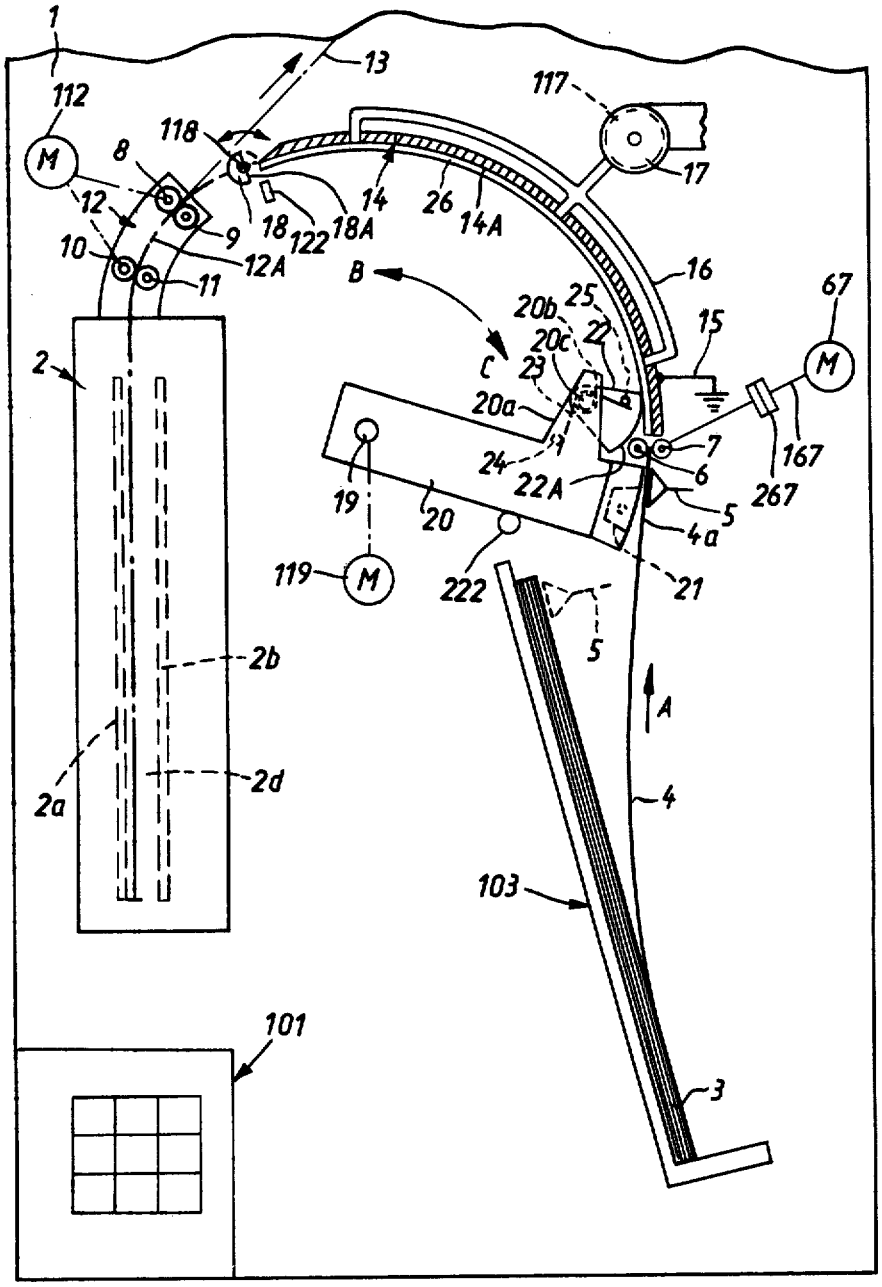
1
112
M
8
118
13
12
9
10
12A
11
18
122
18A
14
26
14A
117
17
16
B
C
20b
25
20c
22
23
15
67
M
2
20a
24
22A
7
6
167
267
5
4a
19
20
119
M
222
21
5
2b
A
2a
2d
4
103
101
3

ELECTRORADIOGRAPHIC APPARATUS

BACKGROUND OF THE INVENTION

The present invention relates to apparatus for making X-ray images, and more particularly to improvements in apparatus wherein latent images of object-modulated X-rays are formed on dielectric receptor sheets while the sheets dwell in the gas-filled interelectrode gap of an ionography imaging chamber. Still more particularly, the invention relates to improvements in means for influencing certain characteristics of dielectric receptor sheets prior to introduction of such sheets into the interelectrode gap of an ionography imaging chamber.

OBJECTS AND SUMMARY OF THE INVENTION

An object of the invention is to provide an apparatus for making latent images of X-rayed objects with novel and improved means for conditioning dielectric receptor sheets prior to entry of such sheets into the interelectrode gap of the ionography imaging chamber.

Another object of the invention is to provide the apparatus with means for influencing the charges of the sheets intermediate a source of supply of sheets and the ionography imaging chamber.

A further object of the invention is to provide an automatic system for destroying the charges of or for applying charges to dielectric receptor sheets prior to admission of sheets into the interelectrode gap of an imaging chamber.

An additional object of the invention is to provide novel and improved means for transporting dielectric receptor sheets toward the ionography imaging chamber and for holding the sheets prior to admission into the imaging chamber.

An ancillary object of the invention is to provide an electroradiographic apparatus with novel and improved means for treating dielectric receptor sheets prior to admission into the interelectrode gap of the imaging chamber.

The invention is embodied in an electroradiographic apparatus which comprises an ionography imaging chamber having a gas-filled interlectrode gap for dielectric sheets, a tray or an analogous source of dielectric receptor sheets, means for transporting receptor sheets seriatim from the source into the gap along a predetermined path, and one or more corona generating devices or analogous means for influencing the charges of receptor sheets in the aforementioned path. The corona generating device or devices can serve to destroy the charge of or to apply a uniform underground potential to receptor sheets in the path between the source and the gap. If the source contains a supply (e.g., a stack) of charged receptor sheets, a single corona generating device can serve to destroy the charges of receptor sheets in the aforementioned path.

In accordance with a presently preferred embodiment of the invention, the transporting means comprises suction-operated stationary guide means which defines an arcuate portion of the aforementioned path, two driven rolls or analogous sheet advancing means at the upstream end of the arcuate path portion, as considered in the direction of transport of sheets along the path, and sheet arresting means at the downstream end of the arcuate path portion. The distance between the arresting means and the advancing means is less than the length of a sheet so that the advancing means can move the leader of a sheet forwardly and beyond the arresting means when the arresting means is moved from an operative position (in which it extends across the path) to an inoperative position in which it is adjacent to the path. The leader of the sheet is then engaged by additional advancing means downstream of the arresting means to be introduced into the interelectrode gap. The guide means has a concave side (which preferably forms part of a cylindrical surface) along which a sheet slides during its transport along the arcuate portion of the path. The corona generating device or devices of the influencing means are preferably mounted on a carrier which is pivotable about an axis coinciding with the axis of the cylindrical surface and moves the corona generating device or devices along a second arcuate path so that the corona generating device or devices are closely adjacent to but out of contact with a sheet which adheres by suction to the concave side of the guide means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a somewhat schematic partly elevational and partly vertically sectional view of an apparatus which embodies the invention, a dielectric receptor sheet being shown in a position it assumes during the initial stage of withdrawal from the source.

DESCRIPTION OF THE PREFERRED EMBODIMENTS

The electroradiographic apparatus which is shown in the drawing comprises a frame or housing 1 which supports an ionography imaging chamber 2, e.g., a chamber of the type disclosed in commonly owned U.S. Pat. No. 4,021,668 granted May 3, 1977 to Josef Pfeifer et al. The chamber 2 comprises two spaced apart flat or spherical electrodes *2a*, *2b* which define a gap *2d* wherein dielectric receptor sheets 4 are exposed to object-modulated X-rays. The sheets 4 may but need not be mounted on sheet-like supports (not shown). The gap *2d* is filled with a high Z gas, such as Xenon, Krypton or Freon. The latent images on exposed sheets 4 are thereupon converted into visible images of X-rayed objects. For example, the chamber 2 may form part of a radiographic apparatus for the making of mommograms.

The housing 1 further supports a source of receptor sheets here shown as a tray 103 which is adjacent to a sheet feeding unit. The tray 103 supports or contains a stack 3 of overlapping dielectric receptor sheets 4 and the sheet feeding unit comprises a mobile transfer element here shown as a suction head 5 which can be moved between the solid-line position and the broken-line position to attract the upper end portion or leader *4a* of the outermost sheet 4 of the stack 3 when it reaches the broken-line position. When moved back to the solid-line position, the suction head 5 places the leader *4a* of the outermost sheet 4 into the nip of two advancing rolls 6, 7 at least one of which is driven, at intervals, in a direction to remove the outermost sheet 4 from the stack 3. The other advancing roll can be biased against the driven advancing roll in the customary way. The means for intermittently driving the rolls 6 and 7 comprises s suitable motor 67.

The rolls 6, 7 cooperate to advance the removed sheet 4 in the direction which is indicated by arrow A whereby the sheet moves along an arcuate portion of its path and the leader 4a of such sheet approaches a second pair of (additional) advancing rolls 8, 9 which are mounted in a sealing unit 12, e.g., a unit of the type disclosed in commonly owned U.S. Pat. No. 4,074,133 granted Feb. 14, 1978 to Jürgen Müller et al. The unit 12 further contains a third pair of advancing rolls 10, 11 which are immediately or closely adjacent to a slot (not specifically shown) through which the leader 4a of the sheet 4 advances into the gas-filled gap 2d between the electrodes 2a, 2b of the ionography imaging chamber 2. The gap 2d is thereupon sealed by an inflatable elastic seal and the pressure of high Z gas in the gap 2d is raised prior to exposure of the sheet 4 in the gap to object-modulated X-rays. The sealing unit 12 comprises means for preventing escape of valuable high Z gas from the gap 2d into the surrounding atmosphere and/or the admission of air into the gap. If desired, the unit 12 may be combined with means for admission of a neutral buffer gas into the channel 12A of the unit 12 in the region between the advancing rolls 8, 9 and 10, 11 in a manner as disclosed in the aforementioned U.S. Pat. No. 4,074,133.

When the exposure of a sheet 4 in the gap 2d is completed, the direction of rotation of the motor 112 for the advancing rolls 8–11 is reversed so that the freshly exposed sheet is removed from the gap 2d and is transported along a path 13 into a developing unit, for example, into a developing unit of the type disclosed in commonly owned copending application Ser. No. 836,541 filed Sept. 26, 1977 by Friedrich Bestenreiner et al. The latent image is converted into a visible image by resorting to toner particles.

During transport from the tray 103 toward the channel 12A of the sealing unit 12, the sheets 4 advance along an elongated path the arcuate portion of which is defined by the concave side 14A of a substantially semicylindrical guide 14 here shown as a plate whose concave side 14A has suction ports or orifices (not specifically shown) connected with suction channels which communicate with several suction pipes 16. The outlets of the suction pipes 16 are connected with the intake of a suction generating device 17, e.g., a pump whose motor 117 is driven at intervals in response to signals which are transmitted by a suitable timer forming part of a control unit 101 mounted in or on the housing 1. The reference character 15 denotes conductor means which connects the metallic guide 14 to the ground. The downstream end of the guide 14 (as viewed in the direction of the arrow A) is adjacent to a mobile arresting device 18 (e.g., a substantially semicylindrical bar) which can be rotated between the illustrated blocking or operative position and an inoperative position by a suitable motor, e.g., a rotary electromagnet which receives signals from the control unit 101 and whose rotary armature is shown at 118. When in the blocking or operative position which is shown in the drawing, the surface 18A of the arresting device 18 extends across the path of forward movement of the leader 4a of a sheet 4 toward the channel 12A of the sealing unit 12. The arresting device 18 remains in the operative position as long as the gap 2d contains a receptor sheet 4 and until the freshly exposed sheet is caused (by the advancing rolls 8–11) to leave the chamber 2 by moving along the path 13.

The center of curvature of the concave inner side 14A of the guide 14 (the inner side 14A forms part of a cylindrical surface) is located on the axis of a shaft 19 which is mounted in the housing 1 and supports a pivotable arm or carrier 20 for a corona generating device 21. The corona generating device 21 is adjacent to but spaced from the path of movement of successive sheets 4 along the concave side 14A of the guide 14. That end portion of the carrier 20 which is remote from the shaft 19 (and which supports the corona generating device 21) is provided with forwardly extending brackets 20a (as considered in the direction of arrow A) for a pivot pin 20c which carries a segmental deformation-preventing member or retainer 22 having a convex surface 22A which can be contacted, under certain circumstances, by the exposed surface of a sheet 4 which advances along the concave side 14A of the guide 14. At least one of the brackets 20a has an abutment or stop 20b against which the retainer 22 normally bears under the action of a torsion spring 23. One leg of the torsion spring 23 bears against a post 24 on the carrier 20 and its other leg bears against a post 25 on the retainer 22. The median portion of the spring 23 is coiled about the pivot pin 20c. The lateral portions of the guide 14 are adjacent or formed with auxiliary guide means here shown as two arcuate guide grooves 26 (only one shown) which receive and confine the respective marginal portions of a sheet 4 while the sheet advances along or is attracted to the concave side 14A of the guide 14.

A sheet feeding device which can be used in the apparatus of the present invention is disclosed in the commonly owned copending application Ser. No. 866,036 filed Dec. 30, 1977 by Walter Bauer et al. The suction head 5, the advancing rolls 6, 7, the motor 67, the guide 8 and the additional advancing rolls 8–11 with their motor 112 can be said to constitute a composite means for transporting successive outermost sheets 4 along an elongated path extending from the source or tray 103 into the gap 2d of the imaging chamber 2. The arcuate portion of the path between the advancing rolls 6, 7 and the arresting device 18 is defined by the concave side 14A of the guide 14.

The operation is as follows:

When the means (not shown) for moving the suction head 5 of the sheet feeding unit receives a signal from the control unit 101, it causes the suction head 5 to move from the solid-line position to the broken-line position and to thereby attract the leader 4a of the outermost sheet 4 in the stack 3. The direction of movement of the suction head 5 is thereupon reversed so that the suction head returns to the solid-line position and places the leader 4a of the outermost sheet into the nip of the advancing rolls 6, 7 at least one of which is driven by the motor 67 to advance the leader 4a along the concave side 14A of the guide 14. If the median portion of the leader 4a of the freshly withdrawn sheet 4 tends to hang or bulge away from the concave side 14A of the guide 14, it contacts the convex surface 22A of the retainer 22 and is compelled to advance along the arcuate path portion (defined by the guide 14) on its way toward the arresting device 18. The marginal portions of the sheet 4 extend into the respective arcuate guide grooves 26 so that the sheet is adequately guided during further movement along the guide 14 and on toward the sealing unit 12. The armature 118 maintains the arresting device 18 in the operative position so that the leader 4a of the sheet 4 comes to a halt as soon as it strikes against the surface 18A. The motor 67 continues to rotate the rolls 6, 7 for a short interval of time to insure that the major portion of the sheet 4 lies flat against the concave side 14A of the guide 14. The motor 67 can be driven continuously if the connection 167 between this motor and the advancing roll 6 or 7 contains a clutch 267 which is disengaged by the control unit 101 as soon as or shortly after the leader 4a of a sheet 4 strikes against the surface 18A of the arresting device 18. The signal which disengages the clutch 267 is preferably used to start the motor 117 of the pump 17 so that the intake of the pump draws air from the pipes 16, as a result of which the minute orifices or ports in the concave side 14A of the guide 14 begin to attract the sheet 4. This insures that the position of the sheet 4 remains unchanged, i.e., the marginal portions of the sheet extend into the respective grooves 26, the convex side of the sheet abuts against and is attracted to the concave side 14A of the guide 14, and the leader 4a of the sheet abuts against the surface 18A of the arresting device 18 which continues to dwell in the operative position.

A motor 119 is thereupon started to pivot the carrier 20 in the direction indicated by arrow B. The circuit of the corona generating device 21 is completed at the same time so that the corona generating device destroys the positive and/or negative charge of the sheet 4 which adheres to the guide 14. Neither the corona generating device 21 nor the retainer 22 contacts the sheet 4 while the carrier 20 pivots in the direction of arrow B. A stop 122 in the housing 1 is located in the path of movement of one of the brackets 20a or in the path of movement of another portion of the carrier 20 to arrest the latter before the retainer 22 can strike against and change the orientation of the arresting device 18 for the leader 4a. If desired, the stop 122 can be placed into the path of movement of the retainer 22 so that the latter is pivoted against the resistance of the torsion spring 23 during the last stage of counterclockwise pivotal movement of the carrier 20. This insures that the corona generating device 21 can be moved all the way (or practically all the way) to the surface 18A of the arresting device 18, i.e., that the corona generating device 21 can influence the charge of the entire sheet portion which is about to enter the interelectrode gap 2d of the ionography imaging chamber 2. The direction of rotation of the motor 119 is then reversed so that the carrier 20 begins to pivot clockwise (arrow C) and returns to the illustrated starting position. A stop 222 arrests the carrier 20 in such starting position. The corona generating device 21 can be deactivated when the carrier 20 begins to pivot clockwise or when the carrier 20 reassumes its starting position.

When the expulsion of a dielectric receptor sheet from the interelectrode gap 2d is completed, i.e., when the trailing end of a sheet which bears a latent image of object-modulated X-rays advances (along the path 13) beyond the inlet of the channel 12A in the sealing unit 12, the control unit 101 reverses the direction of operation of the motor 112 for the advancing rolls 8–11 and arrests the motor 117 for the pump 17. Furthermore, the control unit 101 transmits a signal to start the motor 67 for the advancing rolls 6, 7 (or to engage the clutch 267) and to energize the electromagnet including the armature 118 so that the surface 18A of the arresting device 18 is moved away from the path of forward movement of the leader 4a of the sheet 4 whose maringal portions extend into the channels 26. The rolls 6, 7 then advance the sheet 4 in the direction of arrow B so that the leader 4a of the sheet enters the nip of the rolls 8, 9 and is advanced toward and into the innermost portion of the interelectrode gap 2d. The gap 2d is thereupon sealed from the surrounding atmosphere (and more particularly from the channel 12A (e.g., in a manner as disclosed in commonly owned copending patent application Ser. No. 768,539 filed Feb. 14, 1977 by Kurt Thate et al.) and the sheet in the chamber 2 is ready for exposure to object-modulated X-rays.

The corona generating device 21 can be used to destroy (neutralize) the charge of the adjcent dielectric receptor sheet 4. By destroying the charge, the corona generating device 21 prevents the sheet 4 from distorting the latent image which is formed in the gap 2d. Also, the corona generating device 21 can be activated to apply a uniform charge to the adjacent sheet. If the carrier 20 supports two corona generating devices; one of the corona generating devices can serve to neutralize the charges of the sheets 4 and the other corona generating device serves to thereupon apply a uniform potential to each sheet.

The distance between the nips of the rolls 6, 7 and 8, 9 (and hence the distance between the rolls 6, 7 and the arresting device 18) is less than the length of a receptor sheet 4, as considered in the direction of arrow A or B. This insures that the rolls 6, 7 can advance the leader 4a of a sheet all the way into the range of the rolls 8, 9 as soon as the motor 67 is started (or as soon as the clutch 267 is engaged) subsequent to movement of the arresting device 18 to its inoperative position.

An advantage of the improved apparatus is that the electrostatic charge of a receptor sheet can be influenced in a fully automatic way prior to entry of such sheet into the interelectrode gap 2d. Another advantage of the improved apparatus is that the sheet 4 which is adjacent to the concave side 14A of the guide 14 is automatically compelled to move into full surface-to-surface abutment with such concave side when the leader 4a of the sheet abuts against the surface 18A of the arresting device 18 and the rolls 6, 7 continue to advance the trailing portion of the sheet in the direction of arrow A or B. Such advancement can continue due to inertia of the rolls 6, 7 or due to a slight delay in stoppage of the motor 67 or disengagement of the clutch 267. A further important advantage of the apparatus is that it need not be equipped with mechanical means for permanently biasing the sheets 4 against the concave side 14A of the guide 14. Thus, the retainer 22 is active only in the event when the central portion of the leader 4a of a sheet 4 tends to bulge away from the guide 14 during travel of the marginal portions of the leader 4a in the lowermost portions of the channels 26, as viewed in the drawing. In other words, the transport of successive sheets 4 into the range of the corona generating device 21 is reproducible with a high degree of accuracy in spite of the fact that there is no need for the provision of mechanical biasing means which would constantly urge the sheets against the guide 14 while the corona generating device 21 travels in or counter to the direction of arrow B. Accurate positioning of sheets 4 with respect to the corona generating device 21 is important and desirable because this insures that the corona generating device 21 can apply a uniform background potential to each and every portion of the sheet which is adjacent to the arcuate path of movement of the corona generating device 21, or that the corona generaging device 21 can neutralize the positive and/or negative charge of the sheet 4. In the latter instance, the corona generating device 21 is connected to a source of alternating current. The center of curvature of the arcuate path is located on the axis of the shaft 19, i.e., it coincides with the center of curvature of the concave side 14A.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In an electroradiographic apparatus, the combination of an ionography imaging chamber having an inter-electrode gap for dielectric receptor sheets; a source of receptor sheets of a predetermined length; means for transporting the receptor sheets seriatim from said source into said gap along a predetermined path including suction-operated guide means defining an arcuate portion of said path, sheet advancing means at the upstream end of said arcuate portion, as considered in the direction of transport of sheets along said path, and sheet arresting means at the downstream end of said arcuate portion, the distance between said advancing means and said arresting means being less than said predetermined length; and means for influencing the electrostatic charges of receptor sheets in said path.

2. The combination of claim 1, wherein said influencing means comprises means for applying an electrostatic charge to receptor sheets in said path.

3. The combination of claim 1, wherein said source contains a supply of electrostatically charged receptor sheets and said influencing means comprises means for neutralizing the charges of receptor sheets in said path.

4. The combination of claim 1, further comprising means for operating said advancing means for a predetermined interval of time following the advancement of the leader of a sheet into engagement with said arresting means.

5. The combination of claim 1, wherein said guide means has a concave side which is adjacent to said arcuate portion of said path.

6. The combination of claim 5, wherein said influencing means comprises a corona generating device and means for moving said corona generating device along said arcuate portion of said path.

7. The combination of claim 6, wherein said moving means defines for said corona generating device an arcuate second path whose center of curvature coincides with the center of curvature of said portion of said first mentioned path.

8. The combination of claim 6, further comprising means for moving said arresting means across and from said path.

9. The combination of claim 6, further comprising auxiliary guide means flanking said first mentioned guide means to engage the marginal portions of a sheet which is located in said arcuate portion of said path.

10. The combination of claim 9, wherein said auxiliary guide means defines two arcuate channels.

11. The combination of claim 9, further comprising a retainer operative to maintain a sheet in said arcuate portion of said path intermediate said auxiliary guide means.

12. The combination of claim 6, wherein said concave side constitutes a portion of a cylindrical surface and said moving means comprises a carrier for said corona generating device, said carrier being pivotable about an axis coinciding with the axis of said cylindrical surface and said corona generating device being closely adjacent to but out of contact with a sheet which contacts said concave side.

13. The combination of claim 12, further comprising a retainer mounted on said carrier and operative to engage a sheet which is adjacent to but out of contact with said concave side.

14. The combination of claim 13, further comprising means for pivotally connecting said retainer to said carrier.

15. The combination of claim 12, wherein said moving means further comprises reversible motor means actuatable to pivot said carrier clockwise and counterclockwise.

* * * * *